US008787742B2

(12) United States Patent
Lutz et al.

(10) Patent No.: US 8,787,742 B2
(45) Date of Patent: Jul. 22, 2014

(54) ON-DEMAND WATER HEATING SYSTEM

(75) Inventors: Kenneth E. Lutz, Hickory Corners, MI (US); Evan Lutz, Richland, MI (US); Larry Hartman, Kalamazoo, MI (US)

(73) Assignee: Keltech, Inc., Menomonee Falls, WI (US)

( * ) Notice: Subject to any disclaimer, the term of this patent is extended or adjusted under 35 U.S.C. 154(b) by 413 days.

(21) Appl. No.: 13/196,168

(22) Filed: Aug. 2, 2011

(65) Prior Publication Data

US 2013/0034344 A1 Feb. 7, 2013

(51) Int. Cl.
*F24H 1/20* (2006.01)

(52) U.S. Cl.
USPC ..... 392/451; 392/449; 392/450; 392/454

(58) Field of Classification Search
None
See application file for complete search history.

(56) References Cited

U.S. PATENT DOCUMENTS

| | | | | |
|---|---|---|---|---|
| 5,233,970 | A | 8/1993 | Harris | |
| 6,246,831 | B1 * | 6/2001 | Seitz et al. | 392/486 |
| 6,351,603 | B2 | 2/2002 | Waithe et al. | |
| 7,007,316 | B2 * | 3/2006 | Lutz, II | 4/620 |
| 7,109,453 | B1 | 9/2006 | Nadolski | |
| 7,791,004 | B2 | 9/2010 | Reusche et al. | |
| 7,945,146 | B2 | 5/2011 | Cabrera | |
| 2008/0285964 | A1 * | 11/2008 | Sullivan | 392/485 |
| 2010/0086289 | A1 | 4/2010 | Johnson et al. | |
| 2011/0008030 | A1 | 1/2011 | Luo et al. | |

FOREIGN PATENT DOCUMENTS

| | | |
|---|---|---|
| CA | 2376219 | 12/2001 |
| CA | 2715072 | 8/2010 |
| CA | 2784312 | 2/2013 |
| WO | WO 2006/101326 | 9/2006 |
| WO | WO 2009/020659 | 2/2009 |

OTHER PUBLICATIONS e-comfortusa.com, Noritz N-0841MC-DV Residential Condensing Tankless Water Heater web page, pp. 1-2 "(admitted prior art.)".
http://www.tanklesswataerheaterguide.com, Tankless Water Heater Buying Guide, web pages, pp. 1-8 "(admitted prior art.)".
Canadian Office Action for application 2,784,312 dated Oct. 17, 2013, 4 pages.

* cited by examiner

*Primary Examiner* — Thor Campbell
(74) *Attorney, Agent, or Firm* — Foley & Lardner LLP

(57) ABSTRACT

An on-demand, closed-loop fluid heating system with a control system for providing fluid on-demand at consistent desired precise temperatures. The closed loop assembly may include a heating system, an air separation chamber with an air vent valve, a circulation pump, a small fluid accumulation tank, and plumbing forming the closed loop. Various sensors related to flow and temperature of fluids provide input to the combined feed forward and feed back temperature control system, such as a Programmable Logic Controller that precisely adjusts intermittently outgoing fluid temperature by immediately controlling the amount of heating to the fluid at precisely near usage temperature. Output from the control system can regulate various aspects of the system. A check valve in the closed loop between the system inlet and the system outlet avoids incoming fluid from being mixed with heated outlet fluid.

15 Claims, 4 Drawing Sheets

ON-DEMAND WATER HEATING SYSTEM

FIELD OF THE DISCLOSURE

This disclosure relates to a system and apparatus for an on-demand water heater. More specifically, the disclosure relates to an on-demand, closed-loop water heating system with a control system.

BACKGROUND

Systems and apparatus for on-demand water heating are known. One common system uses a large tank of heated water from which to provide hot water. Some systems use mechanical thermostatic mixing valve that can fail and that require hotter fluids than needed to be mixed with cooler fluid in order to be able to provide somewhat accurate output temperatures.

Tankless systems have been designed to use less energy without heating a large volume of water. Tankless water heaters heat water directly without use of a storage tank which avoids standby heat loss. Tankless water heating products do not function well in environments with intermittent or constant start/stop of water flow. In these conditions, the ability to regulate the water temperature for immediate use is severely compromised—rendering tankless water heaters less effective. Also, tankless systems alone do well with constant flow for long periods of time.

U.S. Pat. No. 5,233,970 discloses a semi-instantaneous water heater with a helical heat exchanger. The water heater generates domestic hot water by transferring heat from the circulating fluid of a modulating boiler. It is particularly suited for use in a combination system, which provides both space and water heating. The semi-instantaneous design incorporates a small cylindrical tank containing stored hot water and an immersed heat exchanger. The heat exchanger is a helical coil disposed in the annular space between two metal sheets that have been rolled into cylinders. The coil conveys heated fluid from the boiler. Heat from the coil is transferred to the water, which is admitted to the tank via the helical passageway formed by the two sheets and the inter-coil space of the helix. The heat exchanger effectively transfers heat by forced convection at a high rate when required by a high flowrate of water. Its disposition in the tank also permits good heat transfer by free convection to quiescent water in the tank when this heating mode is required. The stored volume of hot water provides thermal capacitance to meet brief draws of hot water without short period on/off cycling of the boiler. It also aids in maintaining temperature stability when the hot water flowrate is turned up or down. The small size of the tank allows for effective thermal insulation, thereby minimizing heat loss.

U.S. Patent Publication 20100086289 discloses a modular tankless water heater apparatus with precise power control circuitry designed for use in a system including a water supply conduit and a hot water conduit. The apparatus includes a heating tube assembly with a plurality of tubes positioned in parallel juxtaposition and connected adjacent to the ends into a series connected configuration to form a continuous fluid passage. A heating element is enclosed in each tube and extends between the ends with each heating element including an electrical connector and an electrical control. A programmable electrical power controller is connected to the electrical controls of the heating elements and to flow sensor and heat sensor apparatus positioned in the continuous fluid passage. The controller is programmed to activate the electrical controls one at a time in response to a demand signal from the flow sensor and heat sensor apparatus.

Various control systems are available for water heating systems. A proportional—integral—derivative controller (PID controller) is a control loop feedback mechanism (feedback controller) used in industrial control systems. A PID controller calculates an "error" value as the difference between a measured process variables and a desired set point. The controller minimizes the error by adjusting the process control inputs. The PID controller calculation (algorithm) involves three separate constant parameters, and is accordingly sometimes called three-term control: the proportional, the integral and derivative values, denoted as P, I, and D.

U.S. Patent Publication 20080285964 discloses a modular heating system for tankless water heater for heating water passing therethrough. The tankless water heater includes a control module with a controller and a heating system, each of which are configured in a modular/separate arrangement. The heating system includes an inlet portion, an outlet portion, and a modular heater interconnected therebetween. The modular heater comprises a plurality of heating units, each heating unit comprising a heating tube and a coupler, wherein each heating tube defines an interior region and each heating tube includes a helical structure whereby the helical structure imparts a swirling motion on water passing through the interior region of the tube. A heating element is also disposed within the interior region of the heating tube, and electric power applied to the heating element acts to heat the water passing through the tube. A first temperature sensor may be positioned so as to detect water temperature proximate the inlet portion, and the first temperature sensor is in communication with the controller. Also, a second temperature sensor positioned so as to detect water temperature proximate the outlet portion, and the second temperature sensor is in communication with the controller. Additionally, a flow meter is positioned proximate the inlet portion, and the flow meter, which detects fluid flow (and thereby fluid volume), is in communication with the controller. The controller, receiving the signals from the temperature sensors and the flow meter, directs signals to switches positioned at each tube so as to apply electric current to the heating elements.

Publication WO2009020659 discloses a tankless water heater comprising a pipe, at least one coil around the pipe, at least one heating element located within the pipe and responsive to an electromagnetic field generated by the coil, and a controller to apply an alternating current (AC) signal to the at least one coil, the AC signal applied at a predetermined frequency and magnitude to cause the heating element to heat water flowing in the pipe to a predetermined temperature through induction heating.

Publication WO2006101326 discloses an apparatus and method for controlling temperature of a hot-cold water purifier. The apparatus for controlling temperature includes a display/control unit having indicators for indicating detected and reference temperatures, a hot water switch and a cold water switch, a hot water temperature sensor, a cold water temperature sensor, a controller, a heater and a cooler. The method for controlling temperature controls hot and cold water temperatures of the hot-cold water purifier. The apparatus and method can perform hot and/or cold water power-on/off as well as set reference temperatures to multiple levels desirable to the user, thereby more precisely controlling the temperatures.

SUMMARY

The present disclosure provides a closed-loop, on-demand water heating system with precise control systems, heating elements (i.e. tubes, coils) with various sensors, closed loop designs, and control system for a controlled output temperature of water. The closed loop water heating system is designed to give accurate temperatures and high efficiency.

The on-demand water heater has a feedback control system to precisely adjust intermittently outgoing water temperature by immediately controlling the amount of heating to the water during on-off/start-stop water usage without using large tanks.

The on-demand, closed loop water heating system addresses problems with precise temperatures that are difficult with on-off situations where water is intermittently run for short periods of time. This system helps regulate water temperature for immediate, on-demand use with intermittent or start/stop of water flow. The inclusion of a holding tank and integrated control system allows for constant or intermittent water supply at a desired precise temperature.

The on-demand water heating system is a closed loop water heating system that initially uses full power to bring the water up to temperature and then only uses minimal power to maintain loop temperature. When maintaining the loop temperature, the system only uses enough power to overcome heat loss through the insulated tubes. Incoming cool water is heated to have a continuous flow of hot water out of the system. The temperature of water into the loop is measured, and the temperature is sent to a controller and processed by a PID control algorithm. The system can maintain the water temperature to a deviation of ±2° F.

The inclusion of the small holding tank and integrated control systems allows for constant or intermittent water supply, at the desired temperature, by the end user. Consumers are able to recognize all of the advantages that a prior art tankless electric water heating provides while not being required to alter their usage patterns. The hybrid option allows energy efficient, space saving water heating solutions with accurate temperatures without sacrificing performance or usage demands.

The on-demand, closed loop water heating technology allows the user of the system to heat and dispense fluids continuously with precision. By combining the benefits of a small storage reservoir and an electric tankless heating system with a combined feed forward and feed back temperature control system, this system can provide:

a. Speed—The system can be up and running from a cold start within 5-7 minutes. The system then maintains a ready supply of heated water.

b. No Recovery Time—Once up to temperature, temperatures typically below boiling, the system responds to fluid being supplied by the system and heats the cold fluid entering the system as makeup before it leaves the heat exchanger using a feed forward control system to predict the potential temperature drop before it happens and eliminates it.

c. Small Footprint—The on-demand, closed loop water heating system has dimensions of a tankless system, but the thermal capacity of a much larger tank or boiler system. Tankless systems are typically much smaller than other systems (tanks and boilers) and the on-demand, closed loop water heating system takes advantage of this fact by having a tankless heating system of up to almost 500 kbtu heating capacity combined with an unheated (no internal heat source) reservoir or tank of varying size (generally larger than ¼ gallon but less than 6 gallon dependent upon overall heating capacity of the tankless heat exchanger) placed within a closed plumbing loop using a small circulation pump.

d. Constant Output Temperature—Once up to temperature, usually within 5-7 minutes, the on-demand, closed loop water heating system can provide a constant temperature (within ±2° F.) outlet flow regardless of the fact that it may be constant flow or intermittent on and off flow. Tank systems alone do well with on and off flows and can provide relatively stable temperatures (not within ±2° F.) but they deplete within a short period of time and require a recovery time. Tankless systems alone do well with constant flow for long periods of time. Once up to temperature, within 20-40 seconds, the present system can provide a very controlled and accurate temperature fluid flow for extended periods of time with no depletion or recovery time.

e. No Mechanical Thermostatic Mixing Valve—The on-demand, closed loop water heating system does not use a mechanical thermostatic mixing valve that can fail and that require hotter fluids than needed to be mixed with cooler fluid in order to be able to provide somewhat accurate output temperatures. This would mean higher heat loss potential because on-demand, closed loop water heating system heats the fluid at precisely the usage temperature and not hotter, thus reducing heat loss potential (less energy consumption).

The on-demand, closed loop water heating system combines the advantages of both technologies of tank and tankless into a small, safe, energy efficient and precise system to meet the needs of those commercial and industrial requirements of intermittent fluid flow over extended periods of time with a precise and accurate computer based programmable control system to provide predictability, accuracy and energy efficiency.

BRIEF DESCRIPTION OF THE DRAWINGS

The above-mentioned and other features of this disclosure and the manner of obtaining them will become more apparent, and the disclosure itself will be best understood by reference to the following descriptions of systems taken in conjunction with the accompanying figures, which are given as non-limiting examples only, in which:

FIGS. 1 and 2 of the physical plumbing layout display the configuration opened up for visibility purposes. The preferred layout would have the portion from the pump through the tank rotated and laying alongside the riser tube and heat exchanger making the return loop shorter than is visualized in the drawings. This helps the footprint and the heat loss control.

The exemplifications set out herein illustrate embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiments in different forms, the figures show, and herein described in detail, embodiments with the understanding that the present descriptions are to be considered exemplifications of the principles of the disclosure and are not intended to be exhaustive or to limit the disclosure to the details of construction and the arrangements of components set forth in the following description or illustrated in the figures.

Figure 1:
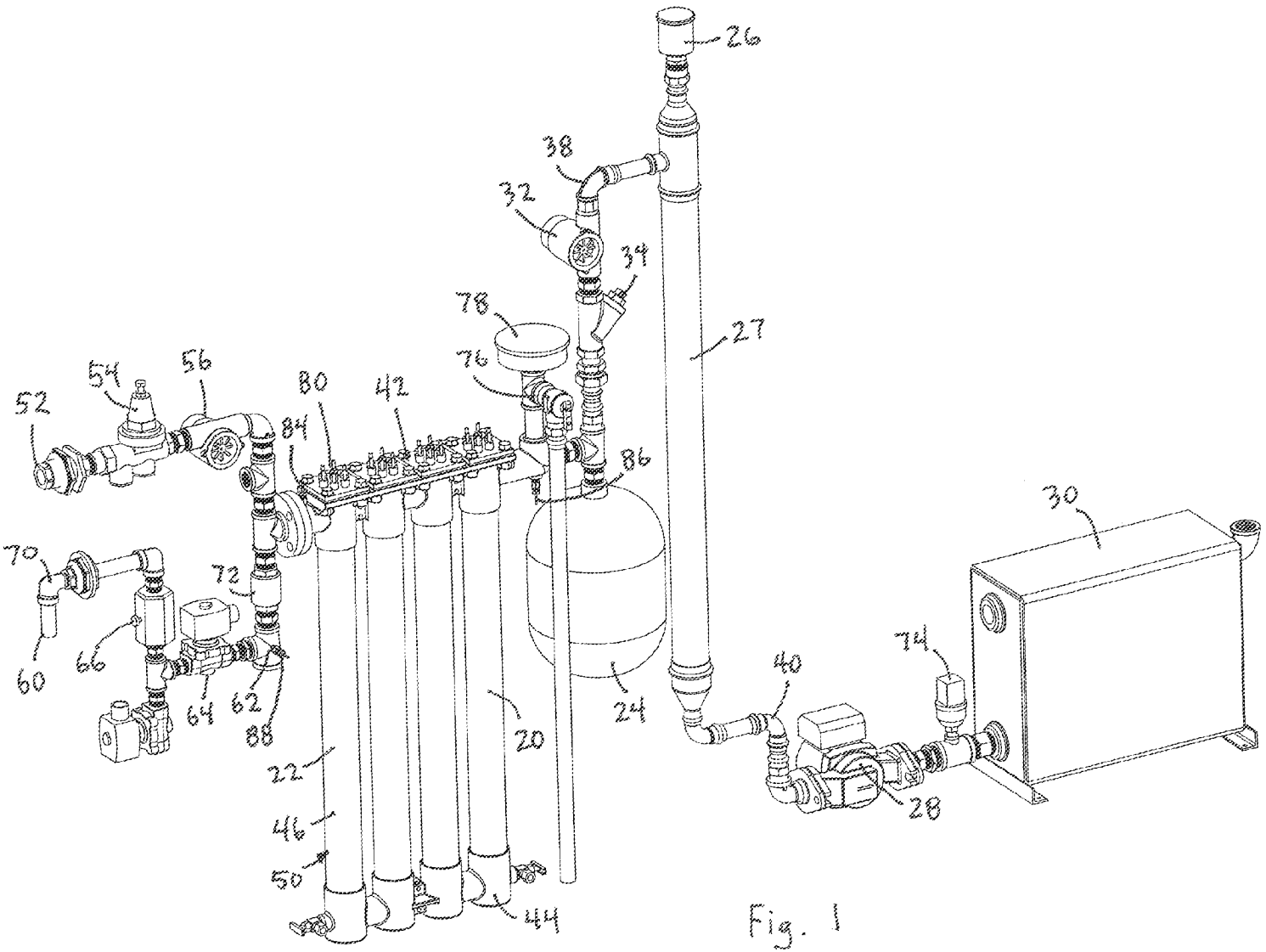
FIG. 1 shows an isometric view of an on-demand water heating system to add a fluid return loop line for a closed loop system.
Figure 2:
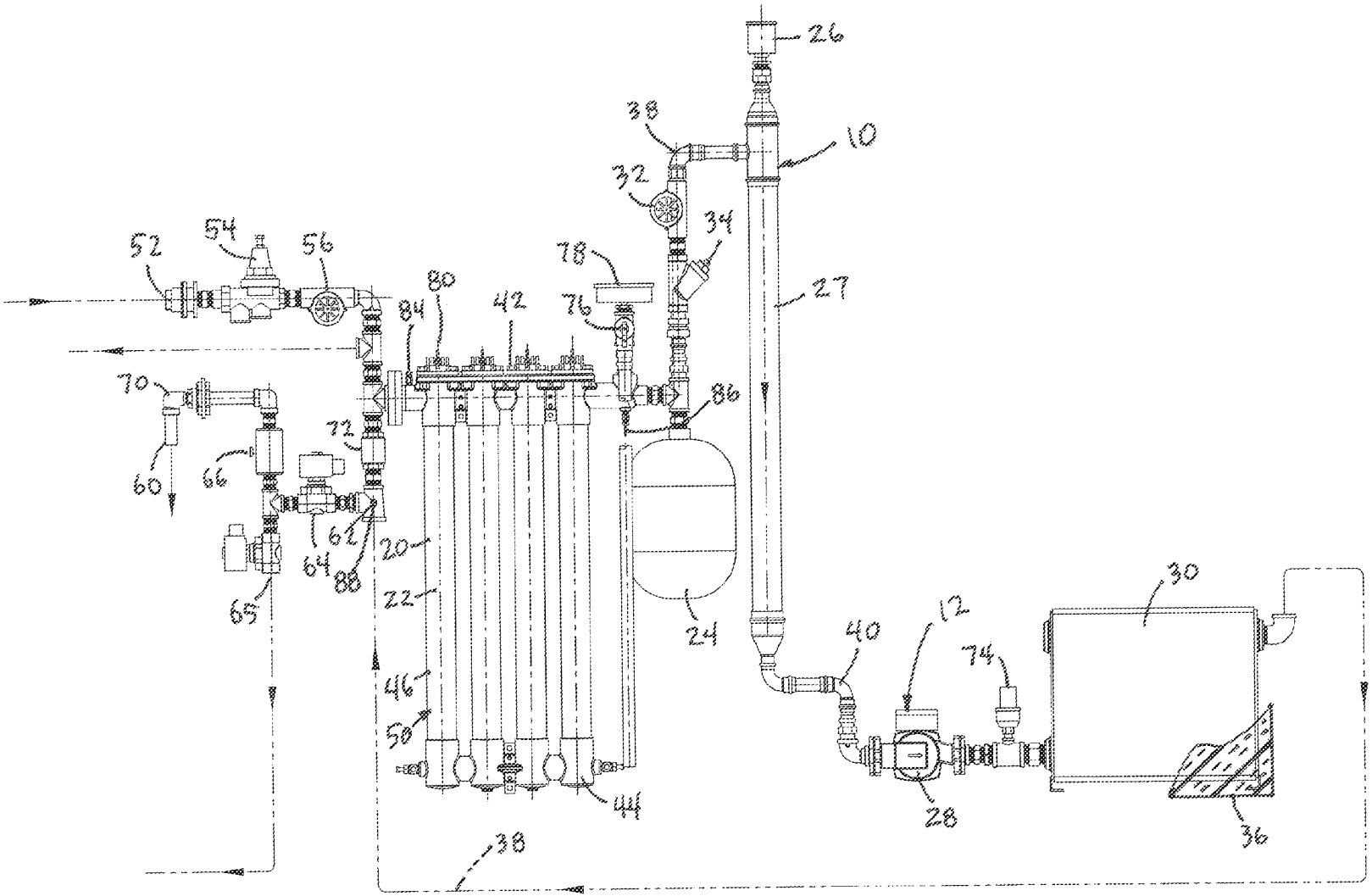
FIG. 2 shows a partial side view of the on-demand water heating system.

As shown in FIGS. 1 and 2, a closed-loop, on-demand water heating system 10 allows the user of the system to heat and dispense fluids continuously with precision. The system 10 includes a closed loop assembly 12 and a control system 14, such as including a microprocessor controller 16.

Closed loop assembly 12 includes a heating system 20 with the major components as a heat exchanger 22, an expansion tank 24, an air vent valve 26, a circulation pump 28, a tank 30, a flow indicating sensor 32, a filter 34, insulation 36, and connected plumbing components 38 and fittings 40 to construct a closed loop heating system.

The heat exchanger 22 can be constructed of brass and copper components, such as a top manifold 42 (brass) and bottom manifold 44 (brass) with connecting tubes 46 (copper) to form a series flow through the heat exchanger 22. Heating elements 48, which are preferably electric, are inserted within the heat exchanger 22 from one end and are totally immersed within the series flow of fluid. A portion of each top and bottom manifold 42 and 44, a connecting tube 46 and a heating element 48 form a heating chamber 50. Typically, there can be one to eight heating chambers 50, but more are possible depending on the required total heating load and required watt density of each heating element 48. As such, the example heating capacity can go to almost 500 kbtu.

An expansion tank 24 with an air bladder 25 is plumbed within the closed loop to provide thermal expansion space but separate the expansion air space from the fluid. Generally, the expansion tank 24 is sized about one gallon.

An air vent valve 26 is also plumbed within the closed loop, ideally in conjunction with an air separation chamber 27. Preferably, an automatic air ventilation/evacuation valve, such as including an air separation vent, is placed at the highest point in the loop to remove all air from the loop with the exception of the air held within the expansion tank 24. Air can enter the system 10 from the fluid supply or separate from the fluid as it is heated with undesirable bubbles and pockets of air that can reduce the life of the heating system 20 and create boiling areas at elevated temperatures within the loop.

A circulation pump 28 is plumbed within the closed loop to create the loop flow. The pump 28, such as a small recirculation fluid pump, can be of sufficient size to create a flow around and within the closed loop of approximate rate of 4-6 times the flow in and out of the system 10.

A tank 30 within the closed loop buffers small temperature changes that the heat exchanger 22 does not remove. An example accumulation tank 30 is typically a rectangular or cylindrical stainless steel tank (depending upon pressure and space requirements). The tank 30 is typically larger than ¼ gallon but less than six gallon as a small reservoir tank. The tank 30 does not need an internal heat source.

A flow indicating sensor 32 is used to verify that the closed loop has a minimum of a threshold flow rate within the loop. The flow indicating sensor 32 is connected to an input to the control system 14 (i.e. a PLC described below) for flow rate information of the loop, which can check to verify that the pump 28 is on and pumping and that there is no obstruction in the flow of fluids. As shown, a flow indicating sensor 32 senses circulation of fluid before it enters the air separation chamber 27.

A filter 34, which may include a strainer, is plumbed within the closed loop to remove dissipated minerals of debris that is a byproduct of the heating process. These minerals, unless removed, can collect in valves or restrictions within the closed loop. Ideally, an inlet filter 34 is upflow from the flow indicating sensor 32.

Insulation 36 is added to all external surfaces of the closed loop to limit and reduce heat loss reflected from the heated surfaces.

The system inlet 52 allows entry of incoming fluid. Unheated or cold fluid enters the loop through an inlet pressure regulator 54. This regulator 54 is connected to the fluid supply and regulates the pressure of the incoming fluid and therefore the outlet feed pressure. The pressure regulator 54 functions as a means of controlling the fluid flow and allowing consistency and predictability to the flow through the system 10. The system inlet 52 is placed at or near the heat exchanger inlet to ensure that the cold incoming fluid passes first through the heat exchanger 22 and brought up to system temperature. The system inlet 52 would also contain an inlet flow sensor 56, such as a makeup fluid flow indicating sensor, to indicate the flow rate and flow start and stop sequence as a signal to the control system 14, if the outlet, described below, does not contain an outlet solenoid and flow control valve.

The system outlet 60 allows heated fluid to exit the closed loop. The system outlet 60 may include a manual controlled outlet or an automatic controlled outlet.

The manual controlled outlet consists of a heated fluid feed solenoid valve 62 and a drain solenoid valve 64 that are controlled by the control system 14. The manual outlet also contains a flow control valve 66 (i.e. an adjustable flow regulator) to precisely control the system outflow. When flow from the outlet 60 is required, signaled to the control system 14 via a fill button 68, the heated fluid feed solenoid valve 62 opens, and verifies that the required flow happened through the "cold fluid" inlet flow sensor 56, provided the loop temperature was within the acceptable temperature band programmed into the control system 14. When the out flow was no longer needed, the button or control signal would be released and the outlet heated fluid feed solenoid valve 62 would be closed and the drain solenoid valve 64 would be opened for a programmed period of time to drain all unused fluid within the outlet plumbing 70 to a standard fluid drain line 65 and be made quickly ready for a subsequent cycle.

An automatic controlled outlet may include manual valves or a closed contact signal from a connected piece of equipment and may operate in much the same method as described above, and the reading of an inlet flow sensor 56 would verify the out flow was happening and at what rate.

Both the manual and automatic system outlet require the addition of a check valve 72. The system outlet 60 is placed upstream of the system inlet 52 in the closed loop flow and the check valve 72 is placed between the inlet 52 and outlet 60 to prevent any incoming cold fluid from flowing backward in the loop and directly out the outlet 60 when the drain solenoid valve 64 (outlet) is open. The system 10 does not mix cool fluid with heated fluid in mechanical thermostatic mixing. As such, fluid is not heated much greater than the desired temperature.

Additional plumbing components can be added for safety, such as a pressure transducer 74 and a pressure and temperature relief valve 76. A pressure transducer 74 can be installed within the closed loop to give the control system 14 a direct reading of system pressure. The pressure transducer 74 is shown just before the tank 30. As an example, if for some reason, the system reaches 90 psi, the heating system 20 could be shut down. A pressure and temperature relief valve 76 can be installed to give a mechanical over ride for pressure and temperature safety. It can be rated for 150 psi and 210 degrees F. The pressure and temperature relief valve 76 can be used in conjunction with a gauge 78.

Limit Controllers and Temperature Control Sensors

Limit controllers 80 and temperature control sensors 84, 86, 88 are preferred. Limit controllers 80 are preferably incorporated for each heating chamber 50. A temperature sensor (RTD or Thermistor type) is inserted into the center of each heating element 48 and is connected to a limit controller 80 for temperature. This limit controller 80 is used as a thermal safety device to turn off the heating element 48 if temperatures exceed preset limits. The limit controller 80 also communicates to the control system 14 (i.e. PLC described below) to indicate a problem and inform the operator through a display 82 (i.e. HMI) tied to the control system 14.

Temperature control sensors 84, 86, 88 can be strategically placed within the closed loop heating system. Each of these temperature control sensors 84, 86, 88 is connected to an input in the control system 14 to provide control information to the control system 14.

Figure 3:
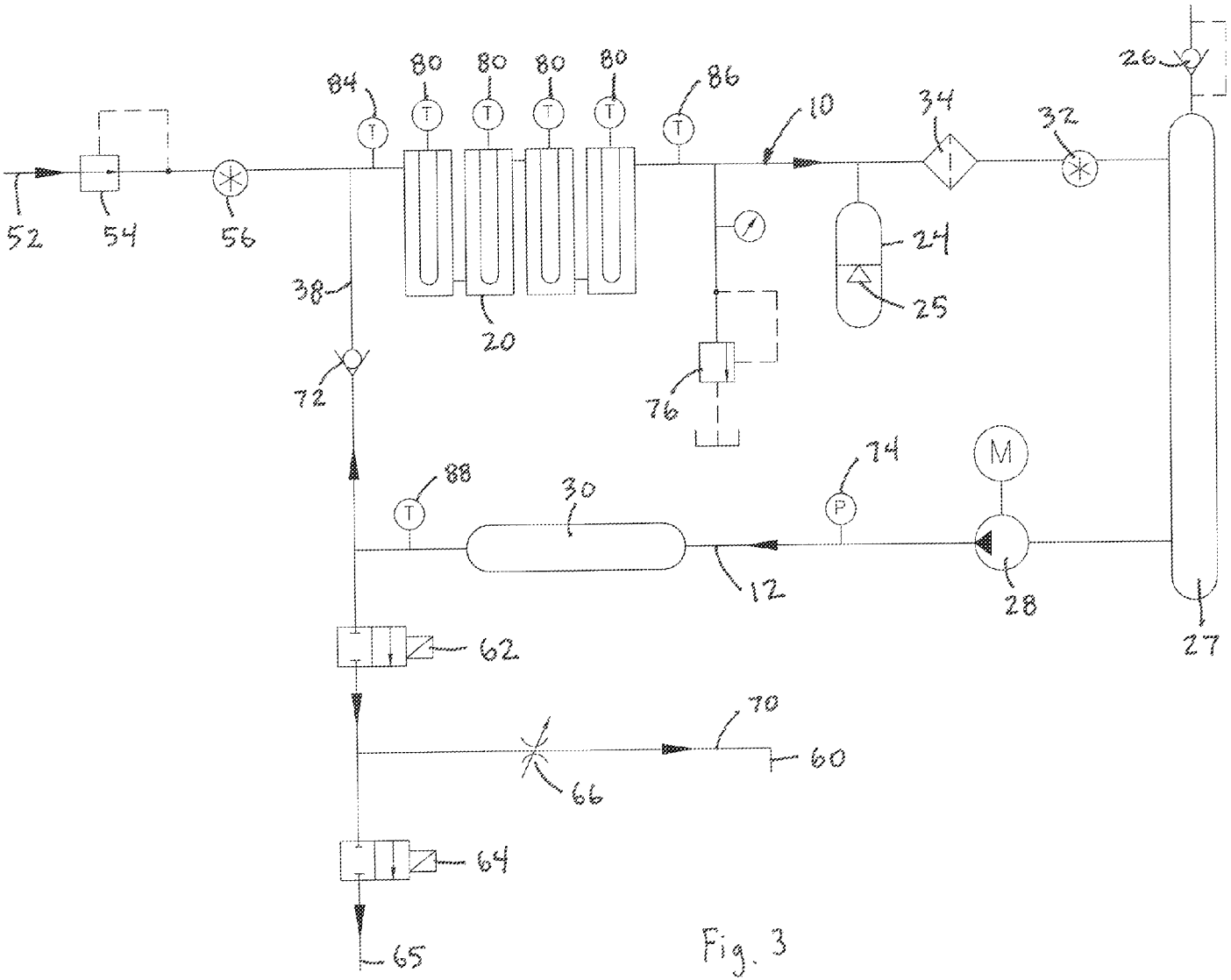
FIG. 3 shows a diagram of the system process.
Figure 4:
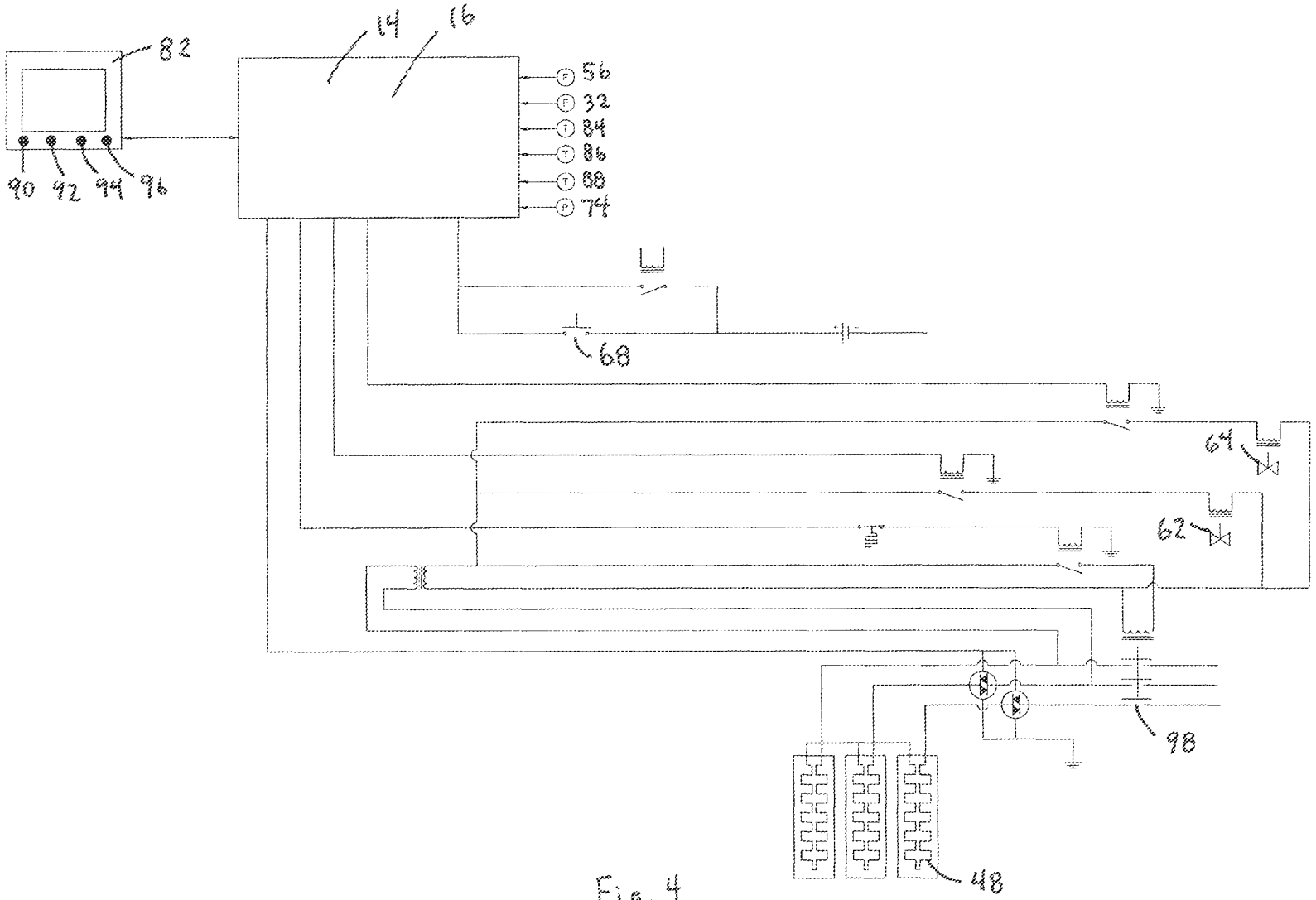
FIG. 4 shows a diagram of the control system.

Incoming temperature control sensor 84 is located in a position in the plumbing diagram of FIG. 3 and measures the temperature of the blended fluid consisting of the fluid flowing around the closed loop and the cold fluid that is entering the loop from the system inlet 52. This incoming temperature control sensor 84 is connected to an input to the control system 14. The temperature of this blended fluid flow and the calibrated flow through the loop (before the heating system 20) gives the control system 14 the ability to predict the overall potential temperature drop of the loop, and the control system 14 adds that lost heat back before the heater temperature sensor 86 (in a position after the heating system 20), that is further downstream in the closed loop, senses a drop (and actually should not perceive a drop because the temperature is brought back up to set point using a feed forward control loop). The control system 14 predictably drives the heating elements 48 on for just the right amount of time and modulation rate so that the heater temperature control sensor 86 does not perceive a temperature change from the loop fluid temperature.

Heater temperature control sensor 86 is preferably located in a position after the heating system 20 as shown in the plumbing diagram of FIG. 3 and measures the temperature of the fluid as it exits the heat exchanger 22. Heater temperature control sensor 86 is connected to an input to the control system 14 and is used in a feedback control loop to control the temperature of the fluid exiting the heat exchanger 22 during the initial system start up and rise to set point and after the feed forward control loop is completed.

Fluid feed temperature control sensor 88 is preferably located in a position adjacent to the outlet 60 as shown in FIG. 3 and measures the temperature of the fluid just before the fluid exits the outlet 60 of the closed loop. Fluid feed temperature control sensor 88 allows the control system 14 to know when the fluid temperature at the point of exit is at the precise temperature required. If given the ability to control the exit solenoid, the control system 14 can hold the exit of the fluid until it is at temperature, to add another degree of accuracy.

Control System

The primary control system 14 is preferably a Programmable Logic Controller (PLC) with a connected display 82 that is placed on an appropriate panel or enclosure face for the use of messaging and entering command inputs into the control system 14. The control system 14 preferably includes a combined feed forward and feed back temperature control system. The feed forward control aspect predicts the potential temperature drop before it happens and eliminates it.

The following inputs into the control system 14 can be used to control the system 10 properly:

a. Temperature Control Sensors 84, 86, and 88.
b. Pressure Transducer 74.
c. Flow (loop) indicating sensor 32 and an Inlet Flow Sensor 56.
d. Fill button 68.
e. Based on number of heating chambers 50, output from each limit controllers 80. (This input is used strictly as thermal safety and is not used as a part of the temperature control.)
f. Emergency stop switch 90 provided for safety and direct operator shutdown. Pressing the emergency stop switch 90 also sends an input signal to the control system 14. This can be a double pole single throw pull to reset switch 92.
g. Reset Button 92 used for initial startup and reset for faults. This can be a single pole momentary contact pushbutton switch.

The following outputs from the control system 14 can be used to control the system 10 properly:

a. Heated fluid feed solenoid valve 62.
b. Drain solenoid valve 64
c. Based on number of heating chambers 50, Solid State Relays are connected in series on their high power side with the heating elements 48 in each heating chamber 50 and require an output signal from the control system 14 to provide voltage to the heating elements 48. This signal is a variable rate that changes the on-time or modulation rate of the heating elements 48 to provide controlled modulated heat output of the heating elements 48.
d. Audible tone alarms 94 to signal the operator as critical phases of operation are completed or as messages are sent to the display.
e. Circulation Pump 28.
f. Cooling fans 96 that are controlled by the control system 14 can be used to keep electronics cool.
g. Based on number of heating chambers 50, a power relay 98 is used for safety disconnect of the heating element 48 circuits. These relays are controlled by the control system 14 and the temperature limit controllers 80.

Precise and accurate computer-based programmable control system 14 provides predictability, accuracy and energy efficiency.

Operation

In operation, several control cycles that must occur to maintain an accurate temperature within the closed loop regardless of what is being asked of the control system 14.

During cold start, a set point is initially set. A user will pull out the emergency stop switch 90 and push the reset button 92, and the control system 14 will energize. The control system 14 will then turn on the circulation pump 28 and cooling fans 96. Once the control system 14 gets verification of fluid flow around the closed recirculation loop via the closed loop flow indicating sensor 32, the control system 14 will energize the power relays for each heating element 48. After a short delay, the control system 14 will begin energizing the solid state relays to begin the heating process. The control system 14 will operate the heating loop at this point on a feedback PID (proportional-integral-derivative described below) control loop, modulating at zero crossing at a duty cycle from 0% to 100%, depending on heating need as dictated by the PID control loop. Starting from cold, the control system 14 forces the load to 100% to reach set point as fast as possible and uses all solid state relays. As the temperature of the loop at the heater temperature control sensor 86 approaches set point within 10 degrees F., the control system 14 turns off one half of the solid state relays, which reduces the heat load by half of the maximum. As the temperature of the loop at the heater temperature control sensor 86 approaches set point within 5 degrees F., the control system 14 turns off another quarter of the solid state relays, which reduces the heat load to 25% of the maximum. When set point is achieved, an alarm 94 can sound to notify status change. The system 10 will reach set point from a cold start, depending on the set point value and the total temperature rise required, typically within 5-7 minutes.

During normal operation and use, the system 10 is up to temperature and is in idle holding mode and is ready for use with options for manual use or automatic operation:

a. In Manual Operation, the intended use operator would request heated fluid by depressing the fill button 68, when equipped, or the control system 14 would sense and verify the requirement happened through a inlet flow sensor 56 (cold fluid).

b. In Automatic Operation, a connected machine or piece of equipment, such as a "bottle quality tester," requiring heated fluid (Automatic Operation) would signal the control system 14 of the intended use by closing contacts provided for this purpose, or the control system 14 would sense the requirement happened through the inlet flow sensor 56.

At the instant of flow due to a requirement for heated fluid to be discharged out the outlet 60, the control system 14 would signal the outlet solenoid 62 to energize (if equipped) and would immediately respond to heat the incoming fluid to set point by applying full load current for a predetermined period to the heating elements 48 to bring the heating elements 48 up to operating temperature. Knowing the temperature of the blended flow around the closed loop at the incoming temperature control sensor 84, the flow rate of the closed loop through the closed loop flow indicating sensor 32, and the available heating capacity as initially programmed during the initial build, the control system 14 uses the following PID (proportional-integral-derivative) equation to determine the modulated power setting level of the solid state relays to enable the heating elements 48 to supply the proper BTU input into the closed loop to again recover to set point.

$$\text{Watts Required} = (SP - M) \times GPM \times \frac{1000 \text{ watts}}{1 \text{ kw}} \times \frac{1}{6.824^\circ \text{ F. } GPM/\text{kw}}$$

Where:

SP=Set Point Value in ° F.

M=Mix Temperature @ Incoming Temp Sensor 84 in ° F.

GPM=Flow around the Closed Loop in gallons/minute

Then:

$$\%\ \text{Output(Required Power Level)} = \frac{\text{Watts Required}}{\text{Watts Available}}$$

Where: Watts Available is a program value determined at build.

This power level is held for a period of time determined by the length of time the outlet feed flow of heated flow and is established by the depressed time of the fill button 68 or the closure time of the connected equipment or the time of inlet flow determined by the inlet flow sensor 56, and an internal timer in the control system 14. At the end of this flow period, the flow will stop and the system 10 will not require a recovery time to come back up to temperature but will revert back to the feed back control loop to maintain the temperature and fine tune the results of the feed forward loop. The recovery was accomplished internal to the flow time. Thus, the flow cycle can be immediately repeated without loss of temperature or overrun of temperature in the heated fluid. It does not matter if the flow cycle produces one or two ounces of heated fluid or the heated fluid from the outlet is constant for long (infinite) periods of time, the heated fluid will be within ±2° F. degrees F. of set point.

During idle holding and hibernation, the system 10 is at set point temperature and is idle but ready to use. The control loop that the control system 14 operates under is a feed back control loop that operates one solid state relay and therefore only one heating element 48 to maintain the set point temperature in the closed loop. Insulation 36 is added to the outside of the closed loop and all exposed heated surfaces, and any cabinet interior, making the duty cycle of idle operation very low. The control system 14 will allow the closed loop to operate at this idle condition for a programmed period of time. This period of time is an operator selectable and changeable period of time, permitting automated shutdown and energy savings between periods of use. At the end of this period of time, unless the control system 14 has had operator input or use, the entire system 10 will hibernate (all heating is stopped and any cooling fans and the pump 28 are turned off) to conserve energy. To return to idle mode, the reset button 92 is depressed, and the control system 14 reenergizes the control loop, which is brought back up to temperature as described above.

After the initial cold startup or after a reset from a hibernation, the on-demand, closed loop water heating system 10 can provide fluid in quantities of ounces or gallons that are at a precise set point temperature, the system 10 was developed particularly for short and repeated on and off flow cycles that need to be at constant temperature. One example of a broad range of product applications is a "bottle quality tester" that operates with frequent on-off blasts of water.

During the fill portion of the cycle for an example "bottle quality tester" application, the system 10 is opened and water is allowed to exit. While the water is exiting the fill head, new cold water is entering the system 10 that now must be heated to have a continuous flow of hot water out. This is done by measuring the incoming water temperature into the loop. That temperature is then sent to the control system 14 and processed by a custom PID control algorithm. Since the entire dynamics of the system has changed dramatically, achieving this with an off the shelf PID control was not possible. With the custom PID control loop, the outlet temperature can be kept within ±2° F. throughout the entire fill. Once the fill is done, the control system 14 determines the amount of cool water still in the system 10 and boosts heating capacity to assure the system 10 recovery time is as short as possible and ready for the next fill.

The disclosed control system 14 has minimal adverse effects (i.e. spikes) on equipment connected to the system 10. The system 10 provides precise temperatures of water in previously difficult on-off situations. The system saves space over prior art tank systems, does not waste substantial water, and uses less energy by not heating water higher than needed and not heating large tanks of water.

This disclosure has been described as having exemplary embodiments and is intended to cover any variations, uses, or adaptations using its general principles. It is envisioned that those skilled in the art may devise various modifications and equivalents without departing from the spirit and scope of the disclosure as recited in the following claims. Further, this disclosure is intended to cover such variations from the present disclosure as come within the known or customary practice within the art to which it pertains.

What is claimed is:

1. A fluid heating system for providing fluid on-demand at consistent desired precise temperatures comprising:

a closed loop with a heating system, an air separation chamber with an air vent valve, a circulation pump, a small fluid accumulation tank, a flow indicating sensor and plumbing forming the closed loop;

a system inlet allowing entry of incoming fluid to the closed loop;

an incoming temperature sensor after the system inlet in the closed loop;

a system outlet that allows heated fluid to exit the closed loop;

a fluid feed temperature sensor in the closed loop adjacent to the system outlet, which measures the temperature of the fluid just before the fluid exits the closed loop;

a control system that receives input from the flow indicating sensor, the incoming temperature sensor and the fluid feed temperature sensor to control the heating system; and a check valve between the system inlet and the system outlet that avoids incoming fluid from being mixed with heated outlet fluid;

wherein the control system determines a modulated power setting level to enable the heating system to supply proper input into the closed loop to again recover to set point with the following calculation:

$$\text{Watts Required} = (SP - M) \times GPM \times \frac{1000 \text{ watts}}{1 \text{ kw}} \times \frac{1}{6.824^\circ \text{ F. } GPM/\text{kw}}$$

Where:

SP=Set Point Value in ° F.

M=Mix Temp. @ the incoming temperature sensor in ° F.

GPM=Flow around the Closed Loop in gallons/minute

Then:

$$\%\ \text{Output(Required Power Level)} = \frac{\text{Watts Required}}{\text{Watts Available}}$$

Where: Watts Available is a program value determined at build.

2. The fluid heating system of claim 1 further comprising a heater temperature control sensor after the heating system in the closed loop for measuring temperature of the fluid as it exits the heating system and is connected to an input to the control system to control the heating system and the temperature of the fluid exiting the heating system.

3. The fluid heating system of claim 1 wherein the circulation pump is of sufficient size to create a flow around and within the closed loop of a rate of 4-6 times of flow in and out of the system.

4. The fluid heating system of claim 1 wherein the small fluid accumulation tank is less than a six gallon capacity without an internal heat source.

5. The fluid heating system of claim 1 further comprising an expansion tank connected to the closed loop.

6. The fluid heating system of claim 1 wherein the heating system is electric having a plurality of heating chambers with a portion of a top manifold and bottom manifold, a connecting tube between the manifolds, and a heating element immersed in the fluid.

7. The fluid heating system of claim 1 wherein the control system includes a combined feed forward and feed back temperature control Programmable Logic Controller that precisely adjusts intermittently outgoing fluid temperature by immediately controlling the amount of heating to the fluid at precisely the usage temperature within a deviation of ±2° F.

8. The fluid heating system of claim 1 wherein the control system provides output to control the system to a heated water feed solenoid valve and to a drain solenoid valve that can be opened to drain unused fluid in the system outlet as controlled by output signals from the control system.

9. A water heating system for providing water on-demand at consistent desired precise temperatures comprising:

a closed loop assembly including an electric heating system with heating elements in a plurality of heating chambers, an air separation chamber with an air vent valve to evacuate air from a closed loop, a circulation pump of sufficient size to create a flow around and within the closed loop of a rate of 4-6 times of flow in and out of the system, a small water accumulation tank that is less than a six gallon capacity without an internal heat source, a flow indicating sensor used to verify that the closed loop has a minimum of a threshold flow rate within the closed loop, an expansion tank with a bladder to provide thermal expansion space, with plumbing forming the closed loop in conjunction with a system inlet with an inlet pressure regulator to regulate the pressure of the incoming water to the closed loop;

an incoming temperature sensor after the system inlet in the closed loop;

a system outlet that allows heated water to exit the closed loop;

a water feed temperature sensor in the closed loop adjacent to the system outlet, which measures the temperature of the water just before the water exits the closed loop;

a heater temperature control sensor after the heating system in the closed loop for measuring temperature of the water as it exits the heating system;

a combined feed forward and feed back temperature control system being a microprocessor programmable logic controller that receives input from the flow indicating sensor, the incoming temperature sensor, the heater temperature control sensor, and the water feed temperature sensor to precisely adjust intermittently outgoing water temperatures by immediately controlling the amount of voltage to the heating elements to heat the water at precisely a usage temperature within a deviation of ±2° F.; and a check valve in the closed loop between the system inlet and the system outlet that avoids incoming water from being mixed with heated outlet water wherein the system does not use cool water to mix with heated water in mechanical thermostatic mixing and the water is not heated more than ±2° F. of the desired temperature.

10. The water heating system of claim 9 further comprising a display for entering command inputs into the control system.

11. The water heating system of claim 9 wherein the closed loop assembly is surrounded by insulation.

12. The water heating system of claim 9 wherein the system outlet includes a drain solenoid valve that can be opened to drain unused water in the system outlet as controlled by an output signal from the control system.

13. The water heating system of claim 9 wherein the control system provides output to control the system to a heated water feed solenoid valve and a drain solenoid valve.

14. The water heating system of claim 9 wherein an output signal from the control system to provide voltage to the heating elements is a variable rate that changes an on-time or modulation rate of the heating elements to provide controlled modulated heat output of the heating elements.

15. The water heating system of claim 9 wherein the system inlet further includes an inlet flow sensor to indicate the flow rate and flow start and stop sequence as a signal to the control system.

* * * * *